US010059055B1

(12) United States Patent
Riffel et al.

(10) Patent No.: US 10,059,055 B1
(45) Date of Patent: Aug. 28, 2018

(54) MASS LOADED VINYL ROLL SUPPORT APPARATUS FOR A SCAFFOLD

(71) Applicants: Eugene Alden Riffel, Escondido, CA (US); Bruce Bailey, Valley Center, CA (US)

(72) Inventors: Eugene Alden Riffel, Escondido, CA (US); Bruce Bailey, Valley Center, CA (US)

( * ) Notice: Subject to any disclaimer, the term of this patent is extended or adjusted under 35 U.S.C. 154(b) by 0 days.

(21) Appl. No.: 15/606,462

(22) Filed: May 26, 2017

(51) Int. Cl.

| | |
|---|---|
| ***B29C 65/00*** | (2006.01) |
| ***B29C 65/52*** | (2006.01) |
| ***B65H 16/02*** | (2006.01) |
| ***B65H 75/42*** | (2006.01) |
| ***B65H 75/44*** | (2006.01) |
| *B29L 31/00* | (2006.01) |

(52) U.S. Cl.
CPC ..... *B29C 65/526* (2013.01); *B29C 66/81* (2013.01); *B65H 16/02* (2013.01); *B65H 75/42* (2013.01); *B65H 75/4468* (2013.01); *B29L 2031/776* (2013.01)

(58) Field of Classification Search
USPC ..... 156/574
See application file for complete search history.

(56) References Cited

U.S. PATENT DOCUMENTS 1,697,478 A * 1/1929 Sandberg ..... B66F 9/07 182/14
1,715,200 A * 5/1929 Lambert ..... E04G 1/20 182/14
2,876,046 A * 3/1959 Owen ..... E04G 1/32 182/225
3,112,009 A * 11/1963 Langer ..... E04G 1/20 182/132
3,156,313 A * 11/1964 Peterson ..... B60B 35/1009 180/209
3,280,939 A * 10/1966 Smith ..... E04G 1/34 182/132
3,282,374 A * 11/1966 Allen ..... B66F 9/06 182/12
3,378,101 A * 4/1968 Zeitler ..... E04G 1/20 182/113
3,731,758 A * 5/1973 Hibma ..... B60P 3/14 180/11
3,785,454 A * 1/1974 Behunin ..... E04G 1/20 182/132
3,865,203 A * 2/1975 Hibma ..... E04G 1/24 180/2.1
3,930,548 A * 1/1976 Wallraff ..... B60P 3/14 180/6.5

(Continued)

*Primary Examiner* — Sing P Chan
(74) *Attorney, Agent, or Firm* — Plager Schack LLP; Mark H. Plager

(57) ABSTRACT

A support apparatus to secure a mass loaded vinyl roll on a scaffold above a ground surface dispenses mass loaded vinyl from the roll with enhanced efficiency for an application on a wall. The support apparatus includes a frame assembly having a pair of upright legs coupled to a generally horizontal bar, each upright leg in the pair of upright legs having a top end with a U-shaped member coupled thereto, a pair of clamps mounted to the horizontal bar to secure the frame to the scaffold, and a spool bar coupled to the U-shaped members of the pair of upright legs and designed to secure the mass loaded vinyl roll thereon.

10 Claims, 6 Drawing Sheets

(56) References Cited

U.S. PATENT DOCUMENTS 4,053,025 A * 10/1977 Slusarenko ..... E04G 1/24 180/15
4,475,611 A * 10/1984 Fisher ..... B60K 1/02 180/11
4,911,964 A * 3/1990 Corbo ..... E06B 3/285 428/212
5,383,312 A * 1/1995 St. Louis ..... B05B 16/40 52/63
5,468,538 A * 11/1995 Nameche ..... B44D 3/00 428/101
5,743,484 A * 4/1998 Baskett ..... B65H 16/00 242/557
5,899,027 A * 5/1999 St. Louis ..... B05B 12/36 52/63
5,937,596 A * 8/1999 Leeuwenburgh ..... B44D 3/00 52/202
6,039,148 A * 3/2000 Riegel ..... E04G 1/24 182/12
6,076,621 A * 6/2000 Horn ..... B62D 51/00 180/19.2
6,141,921 A * 11/2000 Leeuwenburgh ..... E06B 3/285 428/214
6,533,067 B2 * 3/2003 Chick ..... E04G 1/24 180/65.1
6,688,426 B1 * 2/2004 Mikros ..... E06C 1/397 182/107
6,786,299 B2 * 9/2004 Bennett ..... E04G 1/24 182/12
6,793,236 B1 * 9/2004 Mitchell ..... B62B 5/0026 180/2.1
6,880,672 B2 * 4/2005 Imberi ..... E04G 1/24 182/13
6,962,188 B2 * 11/2005 Coenraets ..... A62C 2/10 160/180
7,004,284 B2 * 2/2006 Chick ..... E04G 1/24 182/13
7,073,758 B2 * 7/2006 Whittemore ..... E04G 21/30 24/338
7,165,591 B2 * 1/2007 Trpkovski ..... B29C 63/024 156/353
7,228,936 B2 * 6/2007 Wyse ..... E04G 1/24 182/12
7,357,349 B1 * 4/2008 Huang ..... B65B 67/085 242/405.3
7,533,712 B2 * 5/2009 Whittemore ..... E04G 21/30 160/368.1
7,740,106 B2 * 6/2010 Vetesnik ..... A62B 1/04 182/116
7,828,116 B2 * 11/2010 Vetesnik ..... A62B 1/04 182/115
9,574,356 B2 * 2/2017 Jutte ..... E04G 1/24
9,903,126 B2 * 2/2018 Rowsome ..... E04G 1/24

* cited by examiner

MASS LOADED VINYL ROLL SUPPORT APPARATUS FOR A SCAFFOLD

BACKGROUND

The embodiments herein relate generally to the installation of mass loaded vinyl in buildings.

The transfer of noise through walls and ceilings of buildings is a common problem, especially in older buildings. In order to contain the noise and prevent its transmission to different rooms, mass loaded vinyl is applied to building walls and ceilings. In this configuration, mass loaded vinyl serves as an effective barrier that absorbs vibrations and sound.

The typical installation of mass loaded vinyl to buildings is inefficient and difficult for installers. Mass loaded vinyl is commonly packaged on a roll, which may weigh up to 180 lbs. Mass loaded vinyl is manually unrolled from the roll, cut and held up in the air so that the cut mass loaded vinyl sheet can be mechanically fastened to the wall or ceiling. In some situations, installers have to climb on scaffolds and/or ladders when handling the cut mass loaded vinyl. This installation process requires multiple individuals and often places the body of one or more individuals in an awkward position when maneuvering the heavy mass loaded vinyl roll. This is dangerous and often causes individuals to suffer strains or injuries to their backs or other body areas.

As such, there is a need in the industry for a support apparatus for use with a scaffold that addresses the limitations of the prior art, which supports a mass loaded vinyl roll above the ground to aid individuals to install mass loaded vinyl to walls or ceilings with enhanced efficiency. There is a further need for a support apparatus that improves safety to the installers when handling mass loaded vinyl rolls.

SUMMARY

A support apparatus configured to secure a mass loaded vinyl roll on a scaffold above a ground surface is provided. The support apparatus is configured to dispense mass loaded vinyl from the roll with enhanced efficiency for an application on a wall. The support apparatus comprises a frame assembly comprising a pair of upright legs coupled to a generally horizontal bar, the first upright leg in the pair of upright legs coupled to a first end of the horizontal bar and the second upright leg in the pair of upright legs coupled to a second end of the horizontal bar, each upright leg in the pair of upright legs comprising a top end comprising a U-shaped member coupled thereto, a pair of clamps mounted to the horizontal bar and configured to secure the frame to the scaffold, a spool bar coupled to the U-shaped members of the pair of upright legs and configured to secure the mass loaded vinyl roll thereon; wherein the spool bar permits the mass loaded vinyl to be dispensed from the roll for the application on the wall.

In an alternative embodiment, the support apparatus comprises a primary frame assembly coupled to the scaffold and comprising a pair of upright legs coupled to a generally horizontal bar, each upright leg in the pair of upright legs comprising a top end comprising a U-shaped member coupled thereto, a spool bar coupled to the U-shaped members of the pair of upright legs and configured to secure the mass loaded vinyl roll thereon, and a secondary frame assembly coupled to the scaffold, the secondary frame assembly comprising a pair of upright telescoping assemblies, each upright telescoping assembly comprising an inner tubular member slidably mounted to an outer tubular member, and a guide bar telescoping assembly comprising an inner tubular member slidably mounted to an outer tubular member, an end of the inner tubular member of the guide bar telescoping assembly slidably mounted to one of the pair of upright telescoping assemblies and an end of the outer tubular member of the guide bar telescoping assembly slidably mounted to another one of the pair of upright telescoping assemblies, wherein the spool bar permits the mass loaded vinyl to be dispensed from the roll and disposed around the guide bar telescoping assembly, thereby permitting the application of the mass loaded vinyl to the wall.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
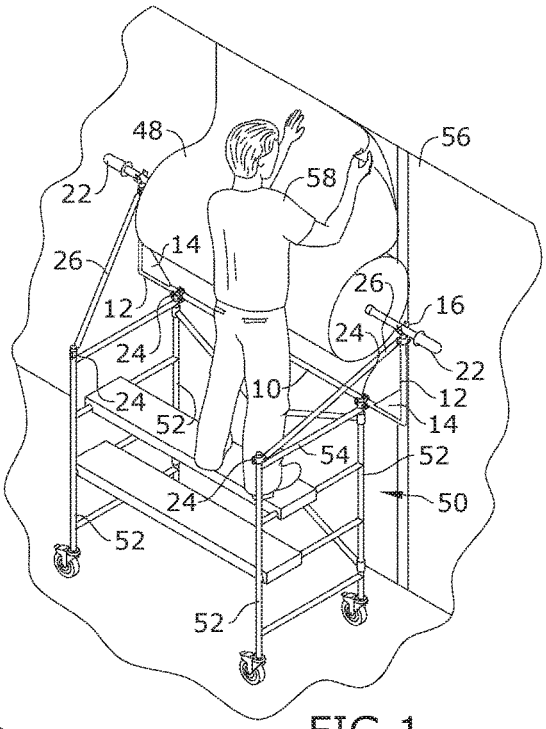
FIG. 1 depicts a perspective view of certain embodiments of the support apparatus shown in use.
Figure 2:
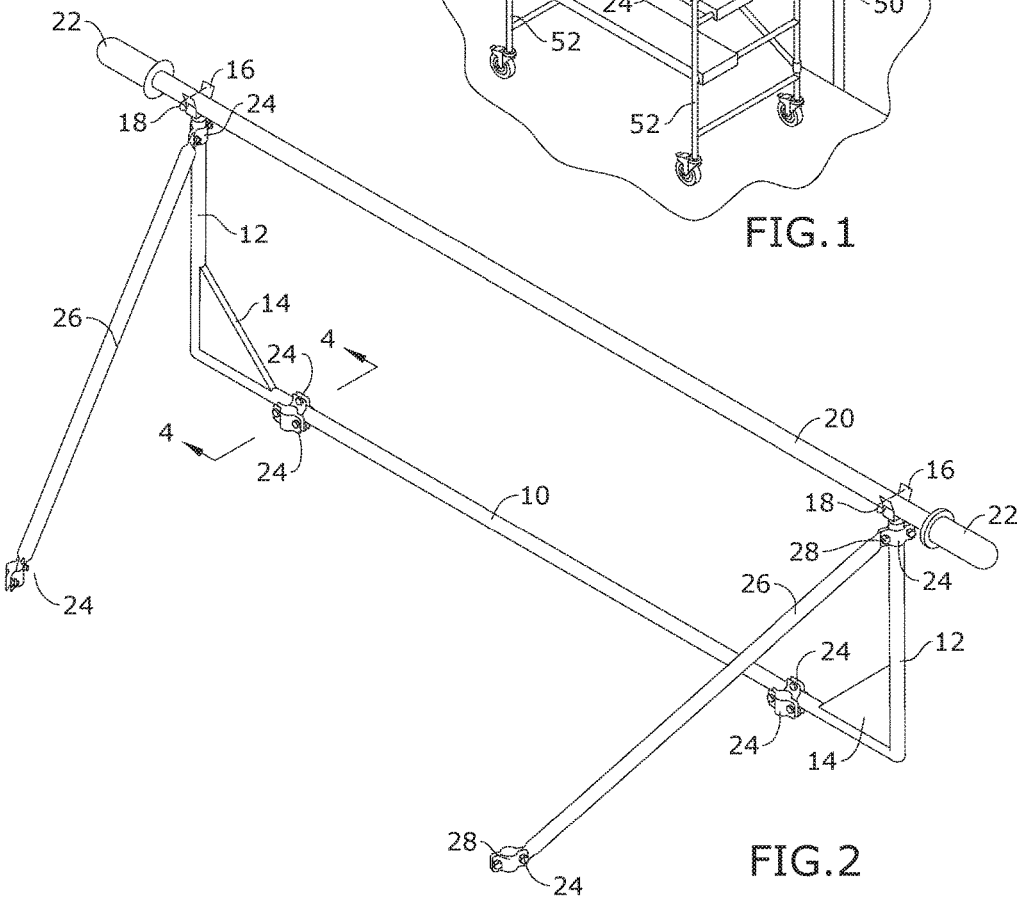
FIG. 2 depicts a perspective view of certain embodiments of the support apparatus.
Figure 3:
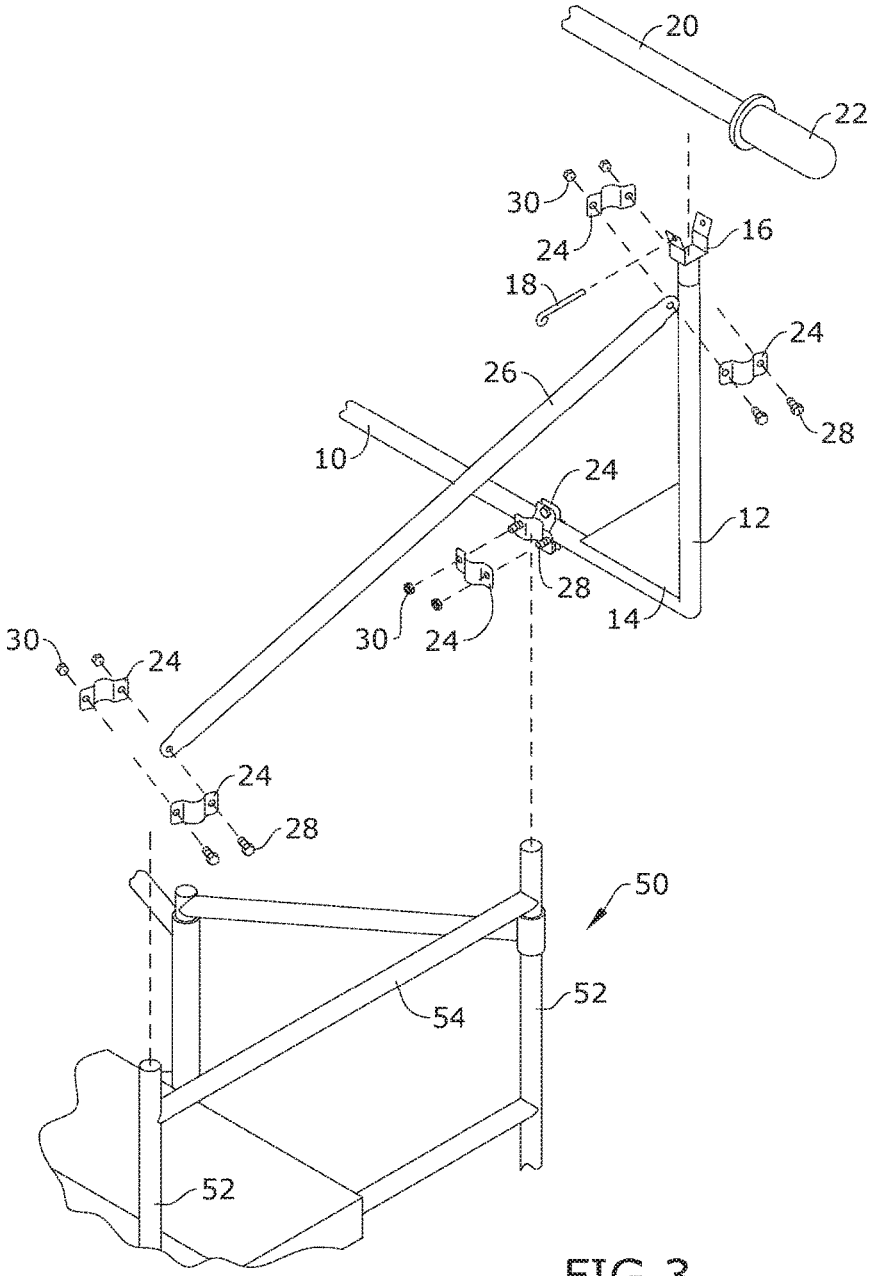
FIG. 3 depicts an exploded view of certain embodiments of the support apparatus.

As depicted in FIGS. 1-3, the support apparatus is coupled to scaffold 50 and is configured to support mass loaded vinyl roll 48 above the ground to permit user 58 to apply dispensed mass loaded vinyl from the roll to wall 56. Scaffold 50 may have variable shapes and sizes. In one exemplary embodiment, scaffold 50 comprises a plurality of scaffold uprights 52 connected to scaffold cross pieces 54. Steps may be coupled to scaffold cross pieces 54 to permit user 58 to stand thereon. Mass loaded vinyl roll 48 may comprise mass loaded vinyl with different sized mass loaded vinyl sheets disposed thereon. In certain embodiments, mass loaded vinyl roll 48 may weigh up to 180 lbs and comprise a width of approximately 4½'-14'. In certain embodiments, the mass loaded vinyl sheet from the roll comprise a thickness of approximately ¼" or ⅛".

In certain embodiments, the support apparatus is preferably made from steel, aircraft aluminum, or alternative known metal in the field. The support apparatus generally comprises horizontal bar 10, upright legs 12, corner braces 14, spool bar holders 16 and outrigger bars 26. Upright legs 12 are coupled to opposing ends of horizontal bar 10.

Upright legs 12 and horizontal bar 10 may be a single continuous member. In an alternative embodiment, upright legs 12 may be separate members that are coupled to horizontal bar 10. Corner brace 14 is coupled to each junction of horizontal bar 10 and upright leg 12. Corner braces 14 enhance the strength and stability of upright legs 12 when supporting weighted loads. It shall be appreciated that corner braces 14 may be welded to horizontal bar 10 and upright legs 12 or other fastening means may be used instead.

A pair of pipe clamps 24 are slidably mounted to horizontal bar 10. These pipe clamps 24 slidably adjust to fit scaffold uprights 52 of different sized scaffolds. As depicted in FIGS. 1 and 3, pipe clamp 24 is coupled to scaffold upright 52 and secured in place by bolts 28 and nuts 30. A pair of outrigger bars 26 is coupled to the pair of upright legs 12 and scaffold 50. Each outrigger bar 26 comprises a first end coupled to one of the pair of upright legs 12 by pipe clamp 24, bolts 28 and nuts 30, and a second end coupled to scaffold upright 52 by pipe clamp 24, bolts 28 and nuts 30.

Figure 4:
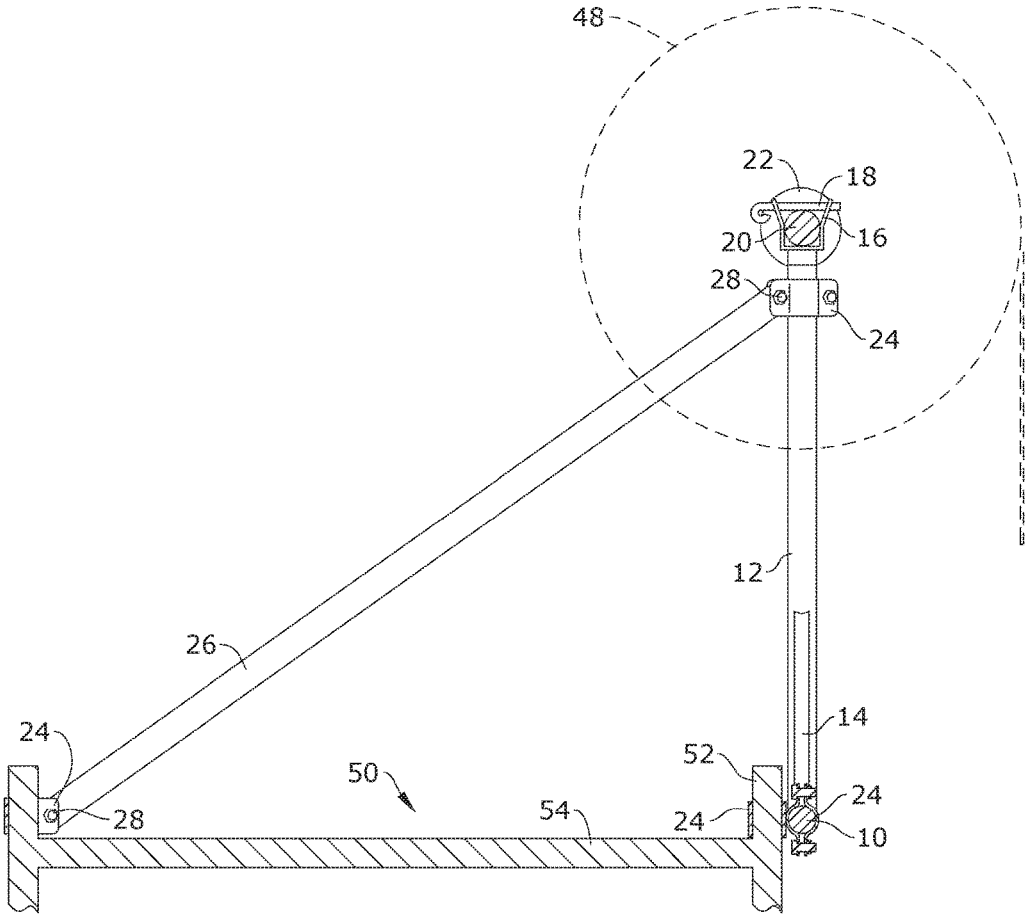
FIG. 4 depicts a section view of certain embodiments of the support apparatus taken along line 4-4 in FIG. 2.

Spool bar holders 16 are coupled to the top ends of upright legs 12. Each spool bar holder 16 comprises a generally U-shaped member configured to receive spool bar 20. Spool bar 20 is an elongated bar with handles 22 on opposing ends. Spool bar 20 is inserted through the center of mass loaded vinyl roll 48. Mass loaded vinyl roll 48 is disposed on the support apparatus such that spool bar 20 is positioned within the pair of spool bar holders 16. As depicted in FIGS. 3-4, pin 18 is coupled to each spool bar holder 16 to secure spool bar 20 within spool bar holder 16. This secures mass loaded vinyl roll 48 to the top of scaffold 50 as depicted in FIGS. 1 and 4.

In operation, user 58 stands on scaffold 50 and dispenses mass loaded vinyl from mass loaded vinyl roll 48. The connection of spool bar 20 within spool bar holders 16 permits user 58 to pull mass loaded vinyl from mass loaded vinyl roll 48 upward. This permits mass loaded vinyl to be dispensed from mass loaded vinyl roll 48, cut and mechanically fastened to wall 56. Since the support apparatus supports mass loaded vinyl roll 48 on scaffold 50 above the ground, user 58 can adhere mass loaded vinyl to wall 56 efficiently and safely. Outrigger bars 26 provide additional stability to the support apparatus and prevent spool bar 20 and mass loaded vinyl roll 48 from swaying forward or backward.

Figure 5:
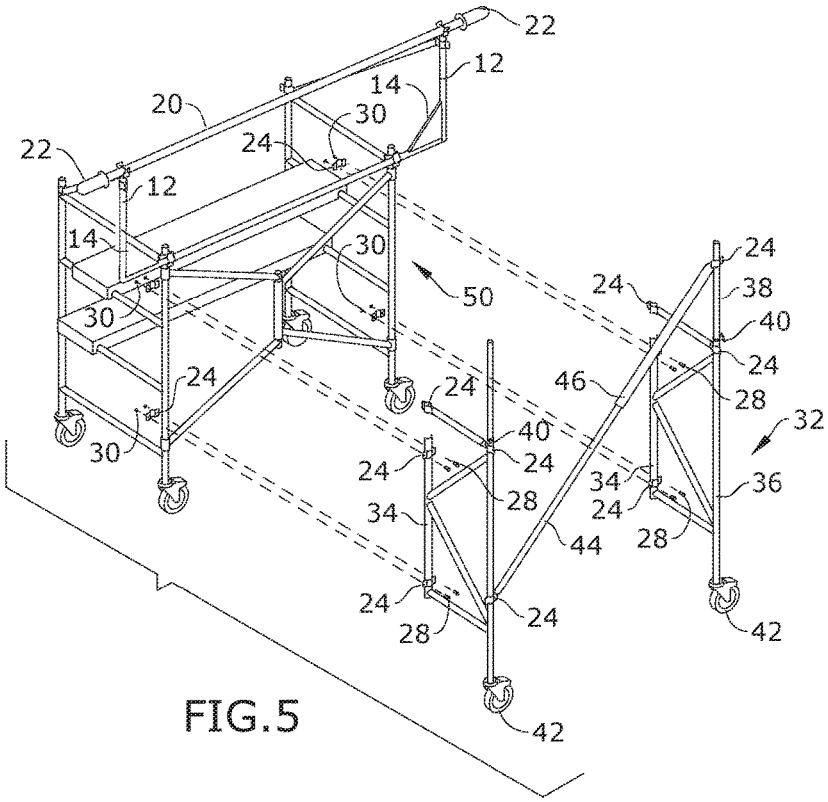
FIG. 5 depicts a rear perspective view of an alternative embodiment of the support apparatus.
Figure 6:
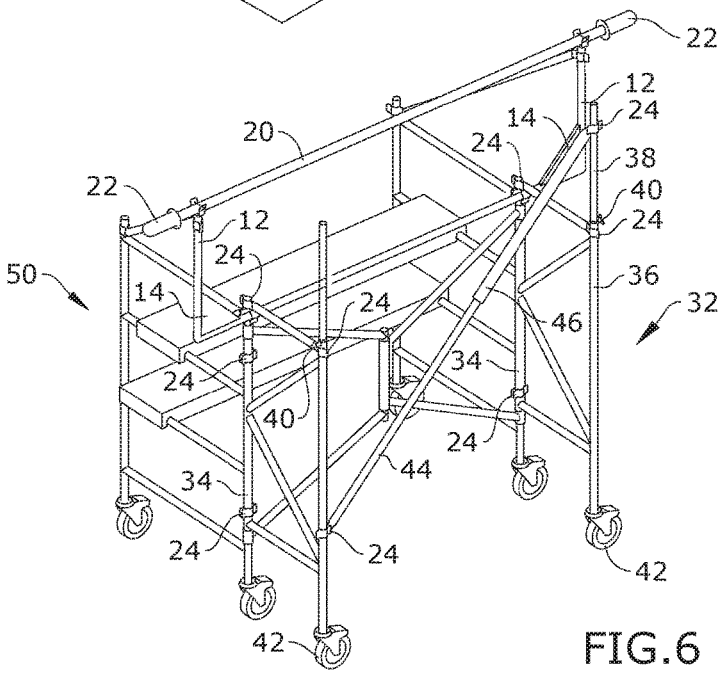
FIG. 6 depicts a rear perspective view of the alternative embodiment of the support apparatus.

FIGS. 5-9 depict an alternative embodiment of the support apparatus for use in installing mass loaded vinyl to ceilings or walls. As depicted in FIGS. 5-6, the support apparatus comprises secondary frame assembly 32 comprising attachment bars 34 coupled to scaffold 50 by pipe clamps 24, bolts 28 and nuts 30. Secondary frame assembly 32 comprises a plurality of bar members coupled together and supported by wheels 42 disposed on the ground.

Figure 7A:
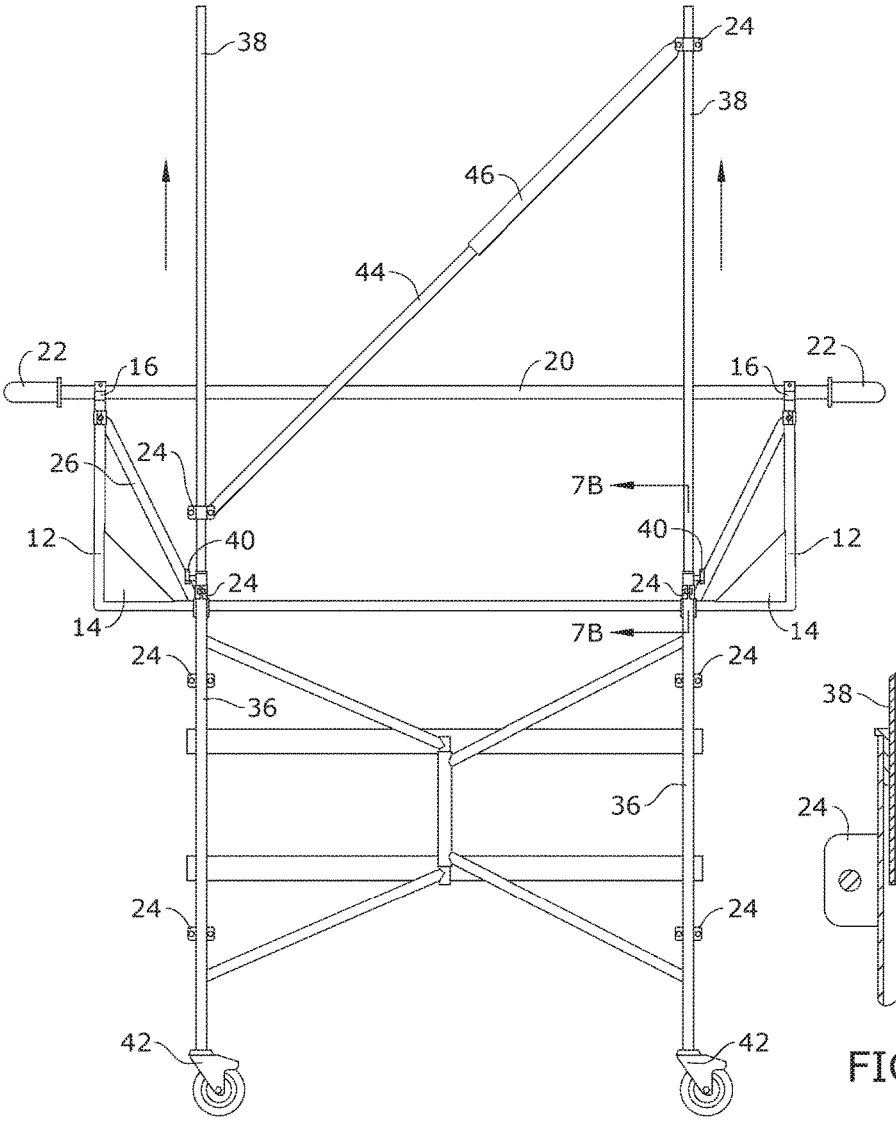
FIG. 7A depicts a rear view of the alternative embodiment of the support apparatus shown in use.
Figure 7B:
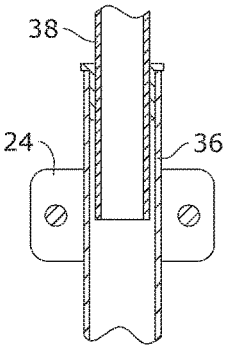
FIG. 7B depicts a section view of the alternative embodiment of the support apparatus taken along line 7B-7B in FIG. 7A.

As depicted in FIGS. 7A and 7B, secondary frame assembly 32 comprises a pair of upright telescoping assemblies comprising inner tubular upright members 38 slidably mounted to fixed outer tubular upright members 36. Each inner tubular upright member 38 is configured to slidably adjust relative to fixed outer tubular upright member 36 to a desired height to reach a ceiling (not shown) up to 10' tall. Each inner tubular upright member 38 may be locked with fixed outer tubular upright member 36 at a desired height by using a locking fastener such as set screw 40 or alternative type of locking mechanism.

Figure 8:
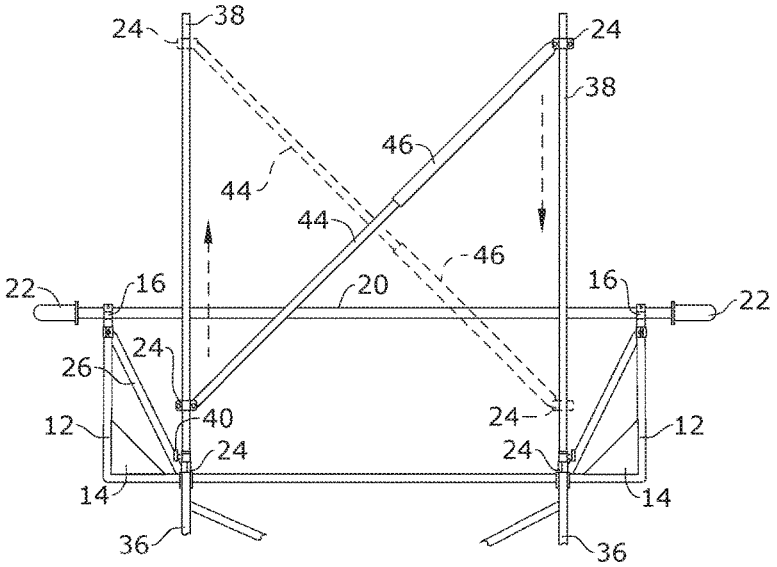
FIG. 8 depicts a rear view of the alternative embodiment of the support apparatus illustrating the adjustment of the telescoping guide bar.
Figure 9:
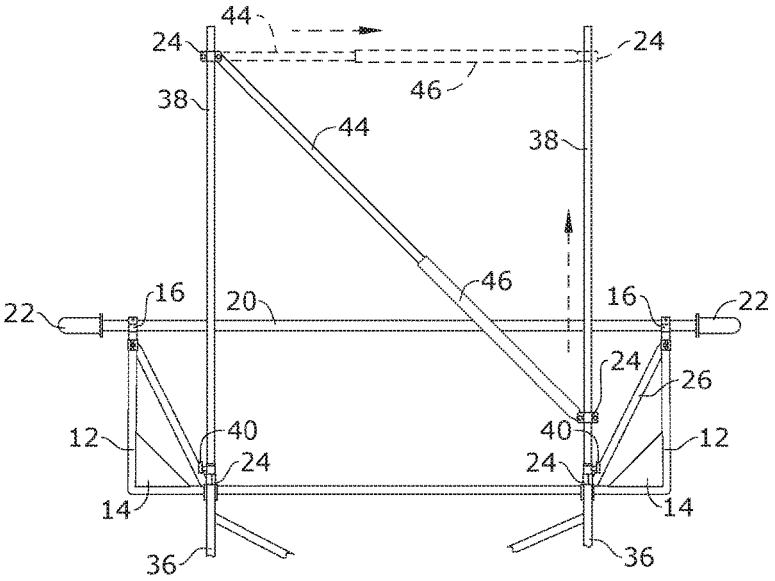
FIG. 9 depicts a rear view of the alternative embodiment of the support apparatus illustrating the adjustment of the telescoping guide bar for mass loaded vinyl ceiling or wall installations.

Secondary frame assembly 32 further comprises a guide bar telescoping assembly comprising inner telescoping member 44 slidably mounted to outer telescoping guide bar 46. The guide bar telescoping assembly is slidably mounted to the pair of upright telescoping assemblies. As depicted in FIGS. 8-9, inner telescoping member 44 is configured to slidably adjust along a first inner tubular upright member 38 and lock in place by pipe clamp 24. Similarly, outer telescoping guide bar 46 is configured to slidably adjust along a second inner tubular upright member 38 and lock in place by pipe clamp 24.

In an exemplary operation, secondary frame assembly 32 is coupled to scaffold 50 as depicted in FIG. 6. Scaffold 50 and secondary frame assembly 32 are positioned against wall 56. Inner tubular upright members 38 are slidably adjusted relative to fixed outer tubular upright members 36 to reach the ceiling (not shown). Inner telescoping member 44 is slidably adjusted relative to outer telescoping guide bar 46 along inner tubular upright members 38 of the pair of upright telescoping assemblies to a horizontal position as depicted in FIG. 9. In this configuration, inner telescoping member 44 and outer telescoping guide bar 46 in the horizontal position is positioned proximate to the ceiling (not shown). This permits one or more users to drape the dispensed mass loaded vinyl from mass loaded vinyl roll 48 over inner telescoping member 44 and outer telescoping guide bar 46 (not shown). This enhances user efficiency when mechanically fastening the dispensed mass loaded vinyl to the ceiling or wall of a building.

It shall be appreciated that the components of the support apparatus described in several embodiments herein may comprise any alternative known materials in the field and be of any color, size and/or dimensions. It shall be appreciated that the components of the support apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A support apparatus configured to secure a mass loaded vinyl roll on a scaffold above a ground surface, the support apparatus configured to dispense mass loaded vinyl from the roll with enhanced efficiency for an application on a wall, the support apparatus comprising:

a frame assembly comprising a pair of upright legs coupled to a generally horizontal bar, the first upright leg in the pair of upright legs coupled to a first end of the horizontal bar and the second upright leg in the pair of upright legs coupled to a second end of the horizontal bar, each upright leg in the pair of upright legs comprising a top end comprising a U-shaped member coupled thereto;

a pair of clamps mounted to the horizontal bar and configured to secure the frame to the scaffold; and a spool bar coupled to the U-shaped members of the pair of upright legs and configured to secure the mass loaded vinyl roll thereon; wherein the spool bar permits the mass loaded vinyl to be dispensed from the roll for the application on the wall.

2. The support apparatus of claim 1, wherein the pair of clamps are slidably mounted to the horizontal bar.

3. The support apparatus of claim 2, further comprising a first outrigger bar comprising a first end coupled to the first upright leg and a second end coupled to the scaffold, and a second outrigger bar comprising a first end coupled to the second upright leg and a second end coupled to the scaffold.

4. The support apparatus of claim 3, wherein each U-shaped member of the first and second upright legs comprises a pin coupled thereto to secure the spool bar therein.

5. The support apparatus of claim 4, further comprising a first corner brace coupled to the first upright leg and the horizontal bar, and a second corner brace coupled to the second upright leg and the horizontal bar.

6. A support apparatus configured to secure a mass loaded vinyl roll on a scaffold above a ground surface, the support apparatus configured to dispense mass loaded vinyl from the roll with enhanced efficiency for an application on a wall, the support apparatus comprising:

a primary frame assembly coupled to the scaffold and comprising a pair of upright legs coupled to a generally horizontal bar, the first upright leg in the pair of upright legs coupled to a first end of the horizontal bar and the second upright leg in the pair of upright legs coupled to a second end of the horizontal bar, each upright leg in the pair of upright legs comprising a top end comprising a U-shaped member coupled thereto;

a spool bar coupled to the U-shaped members of the pair of upright legs and configured to secure the mass loaded vinyl roll thereon; and a secondary frame assembly coupled to the scaffold, the secondary frame assembly comprising:

a pair of upright telescoping assemblies, each upright telescoping assembly comprising an inner tubular member slidably mounted to an outer tubular member; and a guide bar telescoping assembly comprising an inner tubular member slidably mounted to an outer tubular member, an end of the inner tubular member of the guide bar telescoping assembly slidably mounted to one of the pair of upright telescoping assemblies and an end of the outer tubular member of the guide bar telescoping assembly slidably mounted to another one of the pair of upright telescoping assemblies;

wherein the spool bar permits the mass loaded vinyl to be dispensed from the roll and disposed around the guide bar telescoping assembly, thereby permitting the application of the mass loaded vinyl to the wall.

7. The support apparatus of claim 6, further comprising a pair of clamps slidably mounted to the horizontal bar and configured to secure the primary frame assembly to the scaffold.

8. The support apparatus of claim 7, further comprising a first outrigger bar comprising a first end coupled to the first upright leg and a second end coupled to the scaffold, and a second outrigger bar comprising a first end coupled to the second upright leg and a second end coupled to the scaffold.

9. The support apparatus of claim 8, wherein each U-shaped member of the first and second upright legs comprises a pin coupled thereto to secure the spool bar therein.

10. The support apparatus of claim 9, further comprising a first corner brace coupled to the first upright leg and the horizontal bar, and a second corner brace coupled to the second upright leg and the horizontal bar.

* * * * *